US006053431A

United States Patent [19]

Hurley et al.

[11] Patent Number: 6,053,431

[45] Date of Patent: Apr. 25, 2000

[54] LIQUID ATOMIZER

[75] Inventors: John F. Hurley, Easton; John N. Dale, Stratford; Scott H. Lindemann, Oxford, all of Conn.

[73] Assignee: Combustion Components Associates, Inc., Monroe, Conn.

[21] Appl. No.: 09/272,952

[22] Filed: Mar. 19, 1999

Related U.S. Application Data

[63] Continuation-in-part of application No. 08/859,616, May 20, 1997, Pat. No. 5,931,387.

[51] Int. Cl.[7] ..... B05B 1/34

[52] U.S. Cl. ..... 239/492; 239/552; 239/556

[58] Field of Search ..... 239/490, 491, 239/492, 463, 486, 548, 552, 556

[56] References Cited

U.S. PATENT DOCUMENTS

| | | |
|---|---|---|
| 995,981 | 6/1911 | Mills . |
| 1,260,408 | 3/1918 | Leissner . |
| 1,408,521 | 3/1922 | Lathrop . |
| 2,577,901 | 12/1951 | Marlow . |
| 3,669,359 | 6/1972 | Focht . |
| 3,913,845 | 10/1975 | Tsuji . |
| 4,087,050 | 5/1978 | Tsuji et al. . |
| 5,106,022 | 4/1992 | Pook . |

*Primary Examiner*—Andres Kashnikow
*Assistant Examiner*—Lisa Ann Douglas
*Attorney, Agent, or Firm*—Barry R. Lipsitz

[57] ABSTRACT

A liquid atomizer for, e.g., fuel, comprises a tube having an opening for receiving pressurized liquid flow. The tube has a closed end, a wall, and a plurality of bores in the wall. The bores are disposed in consecutive circumferential rows, and are oriented at an acute angle α with respect to a radius of the tube and at an acute angle β with respect to a longitudinal axis of the said tube. A shell having a discharge end with a discharge orifice encircles a portion of length of the tube, including the closed end of the tube. The shell forms an annular chamber around the tube end and an end chamber between the closed tube end and the shell discharge end. Liquid under pressure entering the tube opening is directed outwardly through the wall bores into the annular chamber, into the end chamber, and out through the discharge orifice for introduction, for example, into a combustor.

20 Claims, 2 Drawing Sheets

LIQUID ATOMIZER

This application is a continuation-in-part of commonly assigned, copending U.S. patent application Ser. No. 08/859,616 filed May 20, 1997 now U.S. Pat. No. 5,931,387.

BACKGROUND OF THE INVENTION

The present invention relates to a liquid atomizer, and more particularly to a liquid fuel atomizer for combustors.

For efficient combustion, a liquid fuel flow usually is atomized into fine droplets which burn quickly and completely in the airflow of a combustor. The atomization is accomplished by raising the liquid fuel flow to a high pressure which is then used to develop a liquid fuel flow of high swirl velocity and shearing energy. In prior art atomizers, a rapidly swirling flow is usually developed by passing the high pressure liquid feed flow tangentially and radially inwards through bores in a cylinder wall. The bores lead to a central chamber, in which the rapidly swirling flow is created. The rapidly swirling flow, upon ejection into the combustor, breaks up into a spray of fine droplets which burn readily.

Often, the allowable size of the atomizer, and particularly the atomizer diameter, is limited due to physical constraints of the combustor or other apparatus in which the atomizer is used. In such cases, the atomization task is more difficult, particularly where high fuel flow capacity is needed. It would therefore be advantageous to provide a more compact atomizer for use in a combustor or the like. Such a compact atomizer should be capable of atomizing high fuel flows and using lower liquid fuel supply pressures. The present invention provides a compact atomizer having the aforementioned and other advantages.

SUMMARY OF THE INVENTION

The present invention provides an atomizer of small diameter that can atomize high fuel flows into fine droplets for rapid and complete combustion. Numerous spray patterns can be generated by the atomizer, including segmented spray patterns for, e.g., the reduction of NOx and SOx emissions. Additionally, the atomizer of the present invention uses lower fuel supply pressures than prior art atomizers in order to provide efficient atomization.

A liquid fuel atomizer in accordance with the invention comprises a tube having an opening for receiving fuel, a closed end, and a wall having at least two circumferential rows of spaced bores extending through the wall for passing fuel with a radially outward velocity component. Each bore is disposed at an acute angle $\alpha$ with respect to a radius of said tube and at an acute angle $\beta$ with respect to a longitudinal axis of said tube. The atomizer further comprises a shell having a discharge end with an axial fuel discharge orifice. The shell encircles a portion of length of the tube including the closed tube end, thus forming an annular chamber around the tube wall and an end chamber between the closed tube end and the shell discharge end. Fuel from the wall bores is able to pass into and flow through the annular chamber, through the end chamber, and discharge through the shell discharge orifice.

The tube can include a tapered portion containing the bores. Moreover, the diameter of the bores can be progressive, with the largest diameter bores located in the circumferential rows furthest from the closed end and the smallest diameter bores located closest to the closed end of the tube.

A corresponding method is also provided.

DETAILED DESCRIPTION OF THE INVENTION

Figure 1:
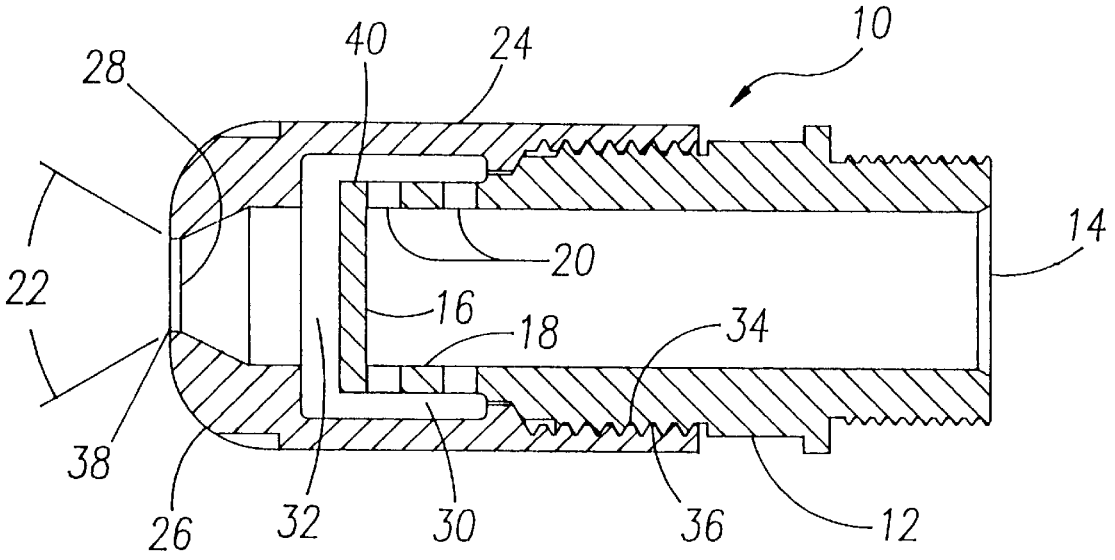
FIG. 1 is a cross-sectional view illustrating the atomizer disclosed in Applicants' prior co-pending application.

With reference to FIG. 1, an atomizer 10 comprises a tube 12 having an opening 14 for receiving a pressurized fuel flow. The tube 12 also has a closed end 16, a wall 18, and at least one bore 20 through the wall 18. In a preferred embodiment, a plurality of bores 20 is provided in a series of circumferential rows, with each row staggered relative to the preceding row such that the bores 20 in each row are offset axially from the bores in other rows. The number of bores and their location pattern are influenced by the desired fuel flow capacity of the atomizer and the spray angle 22 desired from the atomizer.

A shell 24 having a discharge end 26 with a fuel discharge orifice 28 encircles at least a portion of length of the tube 12, including the closed end 16 of the tube, thus forming an annular chamber 30 around the tube end and an end chamber 32 between the closed tube end 16 and the shell discharge end 26. Thus, fuel under pressure entering the tube fuel opening 14 is directed outwardly through the wall bores 20 into the annular chamber 30, into the end chamber 32, and to discharge through the shell orifice 38.

For convenience in assembly of the tube and shell, the tube 12 may have a section of increased outer diameter with an external thread 34. The shell 24 may have an internal thread 36 whereby the shell may be screwed onto the tube external thread 34 to assemble the atomizer 10.

Figure 2:
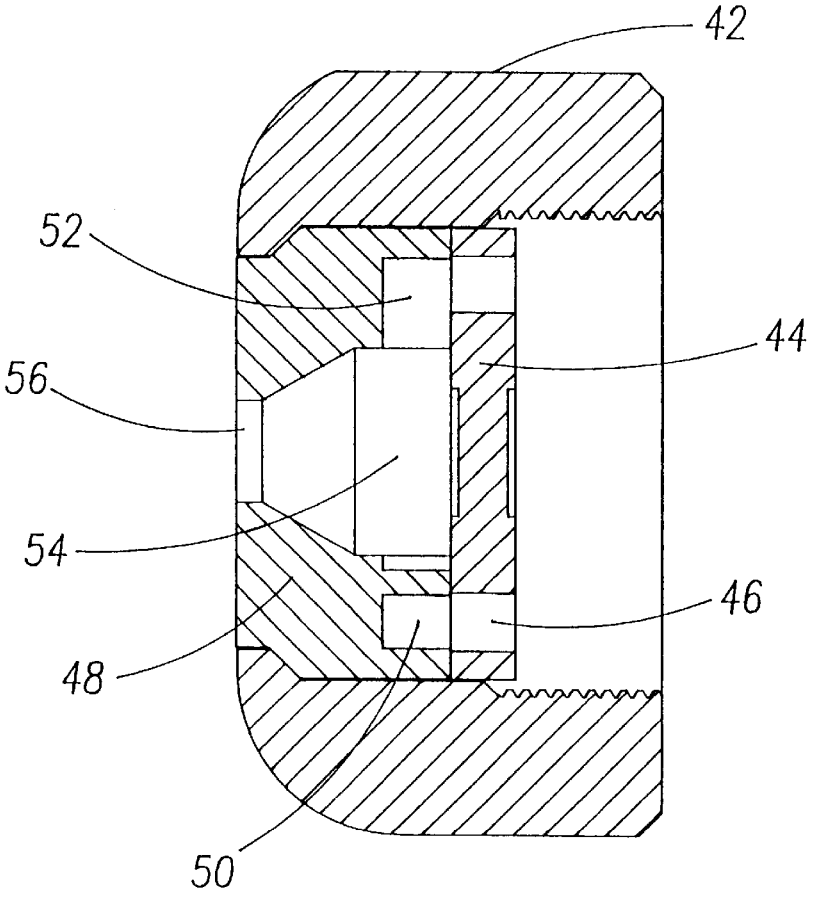
FIG. 2 PRIOR ART
FIG. 2 is a cross-sectional view of a prior art atomizer.

FIG. 2 illustrates the difference between an atomizer constructed in accordance with the present invention and prior art atomizers. In the prior art structure, liquid fuel under pressure is supplied to a cylindrical shell 42 which, at one end, retains a disk 44. The disk, near its outer periphery, has axial passages 46 for alignment with a groove 50 in a sprayer plate 48. Groove 50 is intersected by radial-tangential bores 52, which in turn lead into a cylindrical central chamber 54 that has an axial discharge orifice 56. Thus, fuel flows inwardly through the bores in the sprayer plate and then into the central chamber where a swirling flow is developed. The fuel discharges through the axial orifice into a combustor, producing a spray pattern.

Figure 3B:
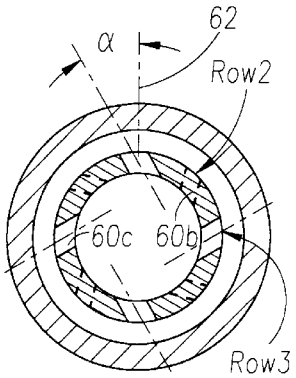
FIG. 3B is an axial cross-sectional view of the atomizer of FIG. 3A taken along the line 3B—3B.
Figure 3A:
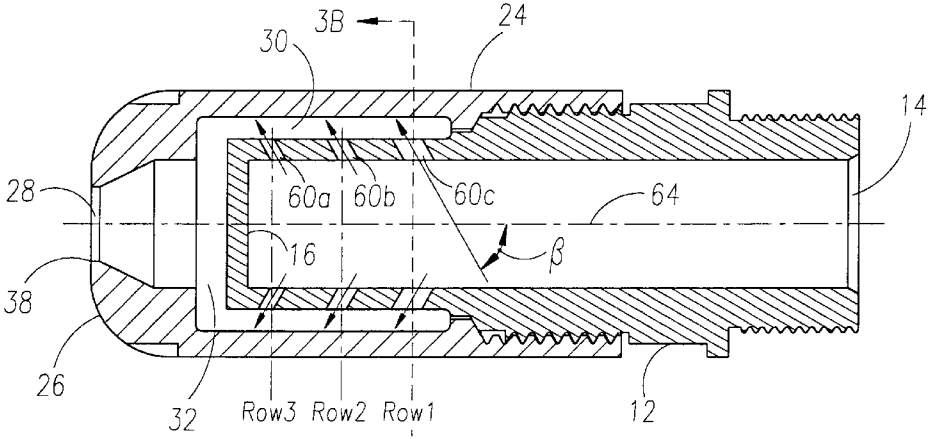
FIG. 3A is a longitudinal cross-sectional view of an atomizer in accordance with the present invention.

FIGS. 3A and 3B illustrate an embodiment of the invention wherein the bores in the tube wall are progressive in flow area and are oriented tangentially to the direction of flow rotation at an angle a with respect to radius 62 of the tube and at a forward angle $\beta$ with respect to the longitudinal axis 64 of the tube. The tangential angle $\alpha$ is used primarily to set the spray cone angle in conjunction with the center-body (i.e., tube 12) and outerbody (i.e., shell 24) geometry of the atomizer. In the preferred embodiment, angle $\alpha$ can range from about 10° to about 45°, with 30° being typical. The whirling motion of fuel is essential to develop a fuel film for atomization droplet break up and to set the ratio of tangential to axial momentum to develop a spray cone angle at the output of the atomizer. The forward angle β, which in conjunction with the angle α forms a compound angle, primarily enables a better flow coefficient for enhanced fuel delivery and atomization with less total pressure required. Basically, the fuel is guided in its direction through the hole orientation rather than being forced to turn in the annular chamber by fluid mechanics forces. In the preferred embodiment, the angle β will be in a range from about 80° to 45°, with 60° being typical.

As for the progressive flow areas of the bores, it is desirable for the bores closest to the closed end 16 of tube 12 to have the smallest diameter, with the diameters of the bores increasing progressively in the direction of the open end 14 of the tube. More specifically, the desired progressive flow is achieved by making the diameter of bores 60*a* smaller than the diameter of bores 60*b*,and the diameter of bores 60*b* smaller than the diameter of bores 60*c*. Multiple rows of flow holes are required to obtain the necessary flow area for a high flow atomizer within a small total volume. Such structure successfully achieves the goal of high flow and efficient atomization within a minimum atomizer volume.

Uniform film distribution is essential in the annular chamber 30 between the centerbody 12 and the outer atomizer body 24. By limiting the amount of fuel injected as the cavity fills in the forward direction, disruption in film thickness is minimized. This improves atomization quality in terms of droplet breakup, since the atomization quality is related to the film thickness and uniformity.

For a cylindrical centerbody such as tube 12 shown in FIG. 3A, the flow areas will decrease from largest to smallest by a×n, where "a" is the smallest bore area and "n" is the number of rows of bores. As an example, with three rows of bores as illustrated, the smallest bore area would be a, the second bore area would be 2a, and the largest bore area would be 3a.

Figure 4:
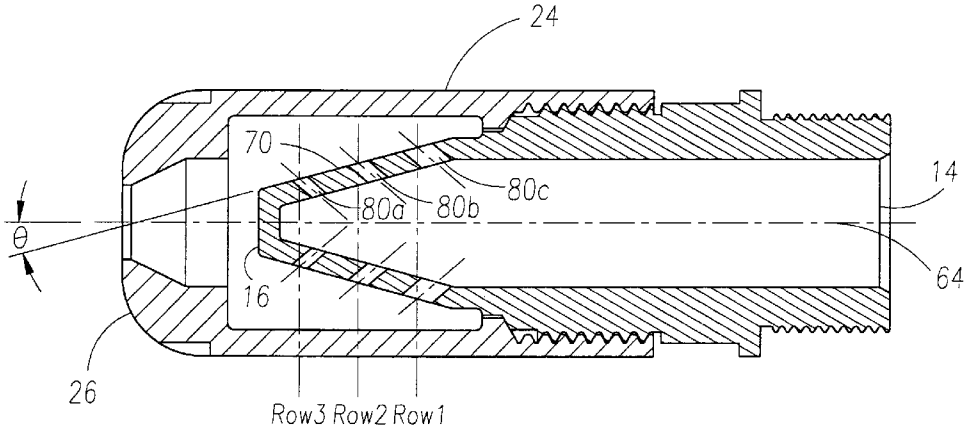
FIG. 4 is a longitudinal cross-sectional view of an alternate embodiment of the atomizer, in which the inner tube is tapered.

FIG. 4 shows another embodiment of a novel atomizer, in which a portion 70 of the tube 12 is tapered. As can be seen, the taper extends at an angle θ with respect to the longitudinal axis 64 from a first diameter at the closed end 16 to a second, larger diameter toward the open end 14. Bores 80*a*, 80*b* and 80*c* with progressively larger flow diameters are provided in the wall of the tapered portion 70 of tube 12. As with the embodiment shown in FIG. 3A, any number of circumferential rows of bores can be provided in this embodiment; the illustration of three such rows in FIG. 4 is for example only. Moreover, the circumferential rows of bores 80*a*, 80*b* and 80*c* are preferably staggered axially, as described in greater detail below.

The tapered tube 70 illustrated in FIG. 4 is referred to as a "diffusing flow centerbody", and in this embodiment even larger fuel flows and more control over spray angle are possible. In such an embodiment, the bore areas with n rows ideally would be:

$$a_n/a_1=(A_n-A_{n-1})/A_1$$

where $A_1$ is the flow area formed between the centerbody 70 and outerbody 24 at first row of bores, e.g., at the location of the largest injection bores 80*c* illustrated in FIG. 4. $A_n$ is the flow area at the location of row "n" of bores. These areas are easily calculated knowing the angle θ and the starting passage geometry, as will be apparent to those skilled in the art. Spacing between the consecutive bore rows is ideally two to three upstream bore diameters. Any centerbody angle θ is possible with a practical range of about 5° to 30°, with 15° being typical.

In all of the embodiments discussed herein, and as best illustrated in FIG. 3B, the bores of each row are also preferably circumferentially staggered with respect to the bores of the other rows. In particular, the bores 60*b* of "row 2" are offset from the bores 60*c* of "row 3." Although the bores 60*a* of "row 1" cannot be seen in the cross-section of FIG. 3B, these bores are also offset from those in rows 1 and 2. In an alternative embodiment, the bores in every other row, or every third row, etc., can be offset from each other, with the bores in two or more of the non-adjacent rows being aligned.

Any number of circumferential rows of bores can be provided depending on the desired flow properties, and three rows are shown in the figures for purposes of illustration only. With such a structure, liquid fuel passing radially outward through the bores with a high pressure drop develops a high velocity with a large radial and a large tangential component. The flow from the bores impinges on the opposed, inner wall of the annular chamber 30, forming on this surface a liquid film rotating with a high rotational speed. The flow whirling with high rotational speed in the annular chamber 30 progresses to the end chamber 32. Progressive flow area and circumferential staging develop considerably improved fuel film layer uniformity in the annular chamber, resulting in better fuel atomization.

Typically the discharge orifice 28 is of smaller diameter 38 than the outer diameter of the tube 12. In such an embodiment, the whirling flow develops a free vortex pattern with an inward radial flow component as it progresses to the shell discharge orifice 28. As the swirling free vortex flow progresses radially inward, its swirl velocity accelerates markedly.

The swirling flow is caused to turn axially and develops a high axial velocity to discharge from the shell discharge orifice 28. The ratio of swirl velocity to axial velocity in the discharge orifice establishes the spray angle 22 (FIG. 1), with larger ratios producing larger spray angles. The high liquid fuel velocities generated in the atomizer 10 provide high energy shearing interfaces which cause a high degree of atomization of the liquid fuel passing through the atomizer.

For spray angles of interest, which typically range from about 55 to 100 degrees, and for desirable atomization, which typically requires an average spray droplet diameter of 200 μm or less, it has been found in atomizers pursuant to this invention that the ratio of the combined flow area of the bores 20 to the product of the shell discharge orifice diameter 38 and tube outer diameter 40 is preferably in the range of about 0.2 to about 1.0. Larger spray angles are produced by smaller ratios. Various spray patterns can be generated, including segmented fuel spray patterns for reducing NOx and SOx emissions.

Comparisons have been made of the geometry of atomizers pursuant to the present invention with the geometry of prior art atomizers. These comparisons indicate that the diameter of atomizers according to the present invention need to be only about half the diameter of prior art atomizers to achieve comparable results. Moreover, to develop adequate velocities for a degree of desired atomization, fuel supply pressures to atomizers in accordance with the present invention may be much lower than the fuel supply pressures used in prior art atomizers. Comparisons of atomizers constructed pursuant to the present invention with prior art atomizers confirms the advantages of the inventive structure. For example, an atomizer pursuant to the present invention with a diameter of less than 1.25 inches, operating at a high fuel flow capacity of 30 gpm with an inlet pressure of less than 300 psig, emits a good quality spray of less than 200 μm average droplet diameter. An atomizer pursuant to the prior art with a diameter of 2 inches, operating at a maximum fuel flow capacity of 20 gpm with an inlet pressure of 950 psig, emits a good quality spray of about 200 $\mu$m average droplet diameter.

Although the invention has been described in connection with a preferred embodiment thereof, it should be appreciated that numerous modifications and adaptations may be made thereto without departing from the scope of the following claims.

What is claimed is:

1. A liquid atomizer comprising:

a tube having an opening for receiving a liquid, said tube having a closed end and a wall having at least two circumferential rows, each row having a plurality of spaced bores extending through said wall at an acute angle $\alpha$ with respect to a radius of said tube and at an acute angle $\beta$ with respect to a longitudinal axis of said tube, for passing said liquid with a radially outward velocity component; and a shell having a discharge end with a discharge orifice for said liquid, said shell encircling a portion of length of said tube including said closed tube end, thus forming an annular chamber around said tube wall and an end chamber between said closed tube end and said shell discharge end, whereby liquid from said bores is able to pass into and flow through said annular chamber, through said end chamber, and discharge through said shell discharge orifice.

2. An atomizer in accordance with claim 1, wherein the bores of successive circumferential rows have progressively smaller diameters as said rows progress in a direction from said opening toward said closed end.

3. An atomizer in accordance with claim 2 wherein the bores within a particular circumferential row all have the same diameter.

4. An atomizer in accordance with claim 1, wherein said tube is tapered over at least a portion of its length from a first diameter at said closed end to a second, larger diameter toward said open end.

5. An atomizer in accordance with claim 4 wherein said taper is at an angle $\theta$ of about 5° to 30° with respect to the longitudinal axis of said tube.

6. An atomizer in accordance with claim 4 wherein all of the circumferential rows of bores reside within the tapered portion of said tube.

7. An atomizer in accordance with claim 6 wherein the bores in each successive circumferential row are staggered with respect to the bores in adjacent row(s).

8. An atomizer in accordance with claim 4 wherein said shell is adapted to be secured to said tube by a threaded engagement.

9. An atomizer in accordance with claim 8 wherein said tube has a section of increased outer diameter with an external thread, and said shell has an end with an internal thread adapted to mate with the external thread of said tube.

10. An atomizer in accordance with claim 1 wherein said angle $\alpha$ is in a range from about 10° to 45°.

11. An atomizer in accordance with claim 10 wherein said angle $\beta$ is in a range from about 45° to 80°.

12. An atomizer in accordance with claim 1 wherein said angle $\beta$ is in a range from about 45° to 80°.

13. An atomizer in accordance with claim 1 wherein the bores in each successive circumferential row are staggered with respect to the bores in adjacent row(s).

14. An atomizer in accordance with claim 1, wherein said tube has an outer diameter and said shell discharge orifice is of smaller diameter than said tube outer diameter.

15. An atomizer in accordance with claim 14, wherein:

said bores have a combined flow area; and said shell discharge orifice has an inner diameter;

the ratio of said combined flow area to the product of said shell discharge orifice inner diameter and said tube outer diameter being in the range of about 0.2 to about 1.0.

16. An atomizer in accordance with claim 1 wherein said shell is adapted to be secured to said tube by a threaded engagement.

17. An atomizer in accordance with claim 16 wherein said tube has a section of increased outer diameter with an external thread, and said shell has an end with an internal thread adapted to mate with the external thread of said tube.

18. A method for atomizing a liquid comprising the steps of:

supplying pressurized liquid into a tube having a side wall with at least two circumferential rows of bores, each bore disposed at an acute angle $\alpha$ with respect to a radius of said tube and at an acute angle $\beta$ with respect to a longitudinal axis of said tube;

passing said pressurized liquid from said tube through said bores into an annular chamber, thereby forming a liquid film rotating with a high rotational speed;

passing said liquid from said annular chamber into an end chamber; and discharging liquid through an orifice in said end chamber.

19. A method in accordance with claim 18 wherein the bores of successive circumferential rows have progressively smaller diameters as said rows progress in a direction toward said orifice.

20. An atomizer in accordance with claim 19, wherein said tube is tapered over at least a portion of its length from a first diameter closest to said orifice to a second, larger diameter away from said orifice.

* * * * *